US005743363A

United States Patent [19]

Rekuc et al.

[11] Patent Number: 5,743,363

[45] Date of Patent: Apr. 28, 1998

[54] SCUFF RESISTANT BAG

[75] Inventors: Richard J. Rekuc, Pattenburg; Carmen Cook, Asbury, both of N.J.

[73] Assignee: Royalox International, Inc., Phillipsburg, N.J.

[21] Appl. No.: 701,378

[22] Filed: Aug. 22, 1996

[51] Int. Cl.[6] ..... A45C 5/14

[52] U.S. Cl. ..... 190/18 A

[58] Field of Search ..... 190/18 A

[56] References Cited

U.S. PATENT DOCUMENTS 5,456,342 10/1995 Rekuc et al. ..... 190/18 A 5,542,510 8/1996 Rekuc et al. ..... 190/18 A 5,575,362 11/1996 Franklin et al. ..... 190/18 A X

*Primary Examiner*—Jes F. Pascua

*Attorney, Agent, or Firm*—Herbert Dubno; Yuri Kateshov

[57] ABSTRACT

A rolling duffle bag or backpack has a stiff supporting sheet and framework attached to the flexible bag upon which a pull-out handle assembly is mounted. An arcuate molded bottom protector is formed with the wheel wells and has an arcuate plate extending from the back around to the bottom and a pair of webs transverse to the plate at opposite ends thereof.

6 Claims, 4 Drawing Sheets

SCUFF RESISTANT BAG

FIELD OF THE INVENTION

The present invention relates to a scuff resistant rollable duffle bag or backpack and, more particularly, to an article having a flexible duffle bag or backpack of fabric or like material which is resistant to scuffing as the article is drawn along the ground.

BACKGROUND OF THE INVENTION

In recent years there has been increasing interest in rollable luggage, both hard case and soft case, utilizing wheels or rollers which are generally mounted on a frame structure and which can be provided with a handle which can be extended from the frame to allow the article of luggage to be drawn along the ground with a minimum of friction. While wheel mounts in such luggage have often been provided on a shield of, for example, a rigid plastic which can lie along two mutually perpendicular walls of the article of luggage so that damage to the walls is prevented when the article is drawn up steps or impacts against irregularities in the ground, the advances in overheated-compartment aircraft-type luggage and even hard-case rolling luggage have not been applied to duffle bags, backpacks and like articles which are more flaccid and less shape retentive than the hard and soft case luggage previously described. A rolling duffle bag is known in which wheels are provided along a bottom which a handle can be extracted to enable the article to be pulled along the ground, but this system nevertheless does not provide reliable protection against scuffing of the edges of the bag where the bottom, for example, adjoins an end wall. The roller mounts in earlier systems have not proved to be fully successful either.

With backpacks, generally speaking frames can be provided but these are intended to support the backpack on the hips and shoulders of the user and, if a rolling article is desired, the backpack has usually been simply placed on a luggage carrier which may be unfolded for that purpose. The integration of rollers in a backpack is thus desirable, although heretofore it has not been possible to adopt conventional roller systems for this purpose and nevertheless insure that the fabrication of the backpack would retain its integrity if the article is drawn along the ground.

OBJECTS OF THE INVENTION

It is, therefore, the principal object of the present invention to provide an improved duffle bag or backpack or a like article with generally ill defined configuration because of unsupported walls of flexible fabric or the like whereby the drawbacks outlined above can be obviated.

It is another object of the invention to provide a rolling article whose wall structures are largely unsupported and flaccid which nevertheless can have advantages of so called soft luggage and even hard case luggage.

It is still another object of the invention to provide a rolling duffle bag or backpack with improved resistance to scuffing and deterioration of fabric walls of the duffle bag or backpack.

SUMMARY OF THE INVENTION

These objects and others which will become apparent hereinafter are attained, in accordance with the invention in a rolling duffle bag or backpack comprising:

a bag of a flexible material having a supported side and free from rigid supporting structures along all other sides of the bag;

a stiff supporting sheet in the bag along the supported side;

an elongated framework secured to the bag and the supporting sheet at the supported side and having a pair of spaced apart parallel tubular guides open at one end of the framework;

a pull-out handle assembly having a pair of shanks received in the guides and extendable therefrom to enable pulling of the bag over the ground, and a handle bridging the shanks;

a one-piece abrasion-resistant bottom protector molded from a synthetic resin material and disposed at an opposite end of the framework along an exterior of the bag, the bottom protector being formed with an arcuate plate having a large radius of curvature and extending through an arc of substantially 90° between a first substantially planar portion secured to the supported side and to the sheet and a second substantially planar portion secured to an end of the bag and at a right angle to the first portion, the bottom protector being formed unitarily with a pair of webs transverse to the plate at opposite ends thereof and flanking the bag along further sides thereof the webs connecting the portions, the bottom protector being further formed unitarily with respective wheel wells in a region of the arc proximal to the webs; and respective wheels rotatably mounted in the wheel wells.

According to a feature of the invention, this bottom protector is further formed with a pair of pockets open toward the framework and receiving the tubular guides.

Advantageously, the framework is formed with a bridge connecting the tubular guides and provided with a push button latch for locking the assembly selectively in a retracted and in a extended position.

The arc can have a relatively large radius of curvature, e.g. 4 to 8 inches and preferably between 4.5 and 6 inches.

While duffle bags and backpacks are themselves well known articles, it should be understood that both are characterized by an opening at least at one side with means for closing that opening, e.g. via a slide fastener, ties or straps. Most of the walls of the article, which is generally composed of a flexible fabric, are flaccid and unsupported and when reference is made here to a flaccid structure, we intend to thus indicate that the flaccid walls are not connected by any rigid members to the framework previously described or the aforementioned relatively stiff sheet. These walls can thus fold up or collapse toward the framework or sheet readily.

Of course, this does not exclude shaping welts or beads of fabric or even independent stiffeners which are not connected to a framework or the stiffening sheet and thus do not stiffen the bag as a whole.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
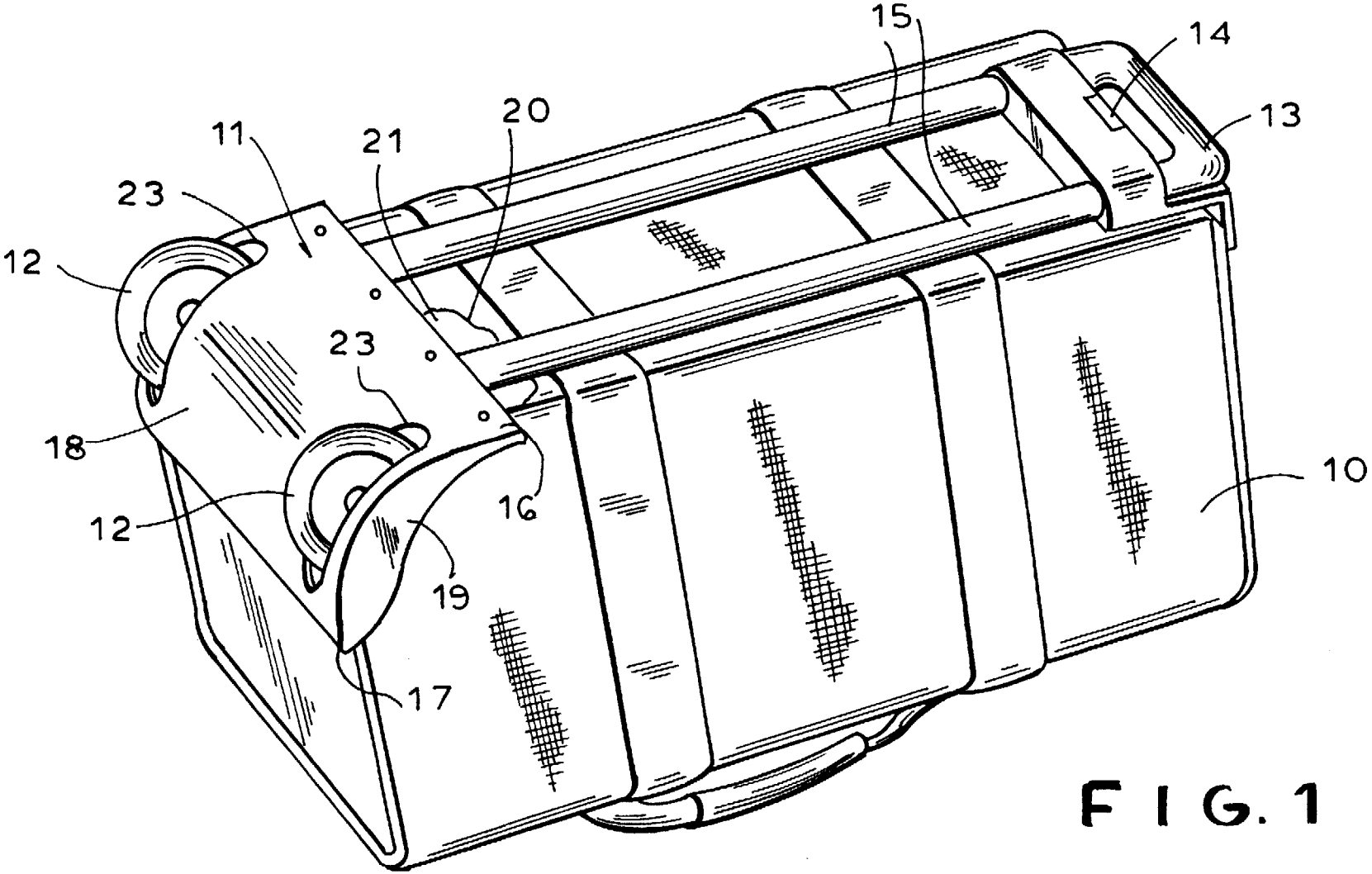
FIG. 1 is a rear perspective view of a duffle bag provided with the scuff resistant member of the present invention.

From FIG. 1 it will be apparent that a duffle or like flexible wall bag, represented generally at 10 can have, provided along the bottom either a rear of the bag, a one piece molded scuff resistant member 11 which can be fitted with a pair of wheels 12 on which the duffle can roll when a handle 13 is extended upon depression of a handle lock button 14, the handle having shanks 15' is guided in tubes 15, here shown to be on the exterior on the duffle but which can also be provided on the interior thereof. The tubes 15 can lodge in seats of the protective member 11 which will be described in greater detail below.

The scuff preventing member 11 has planar portions 16 and 17 including a right angle with one another and a cylindrical rounded portion 18 bridging these planar portions and of a radius of curvature preferably in excess of 4 inches. A pair of webs 19, one of which only is seen in FIG. 1, extends along the sides of the bag connecting the planar portion 16 and 17 so that the bottom edge of the bag where the bottom adjoins the rear wall and the resulting corners are all fully protected.

The fabric of the bag is broken away at 20 to reveal a rigid sheet 21 to which the member 11 can be connected through the fabric of the bag by rivets or bolts shown at 22. The wheels 12 are received in wheel wells 23 unitarily formed on the member 11.

Figure 2:
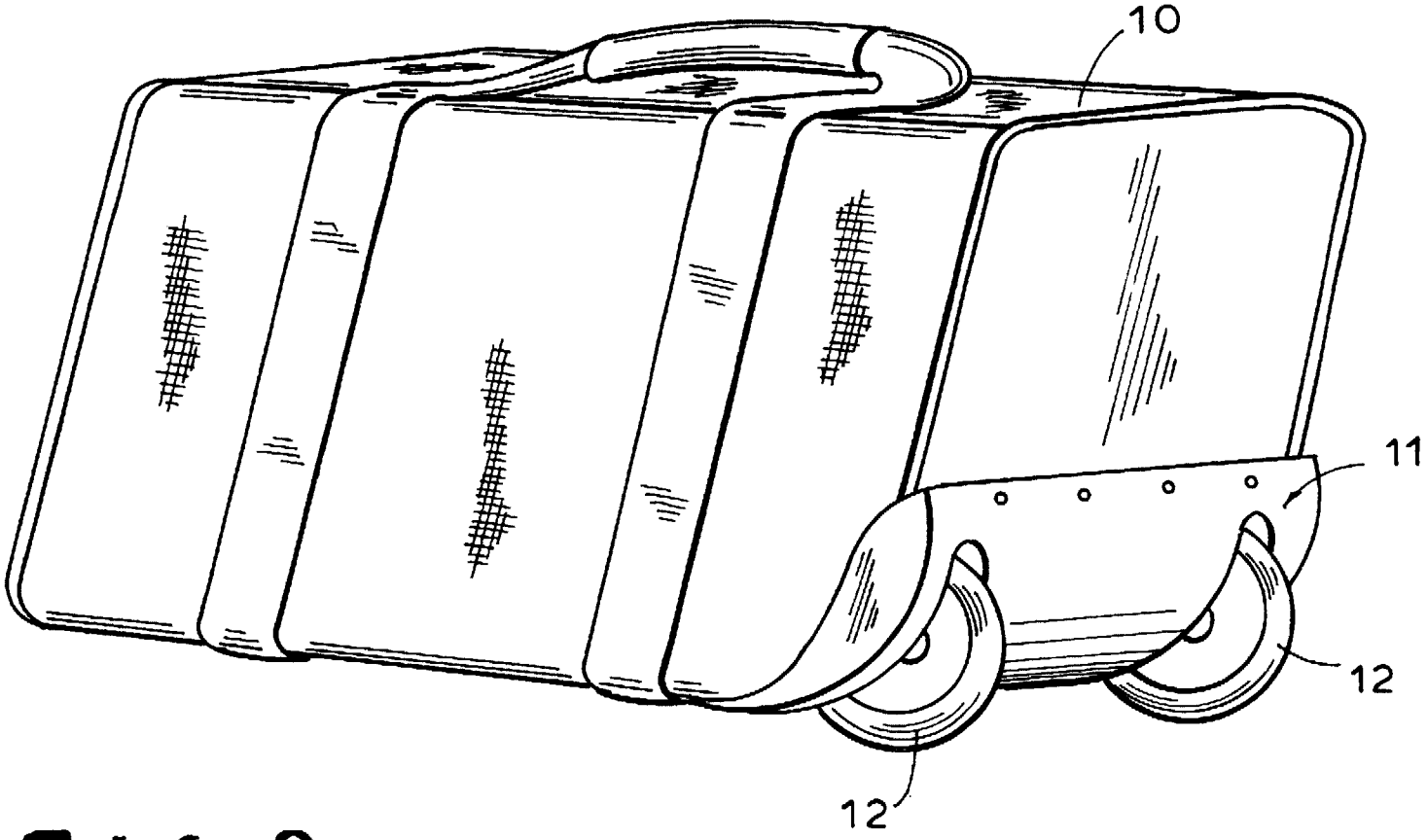
FIG. 2 is a side view, also in perspective, of the rolling duffle.

From FIG. 2, it will be apparent that the member 11 and the wheels 12 can support the duffle 10 when it is rolled from the pulling position. The top 24 of the duffle is visible in this FIG. 9 well.

Figure 3:
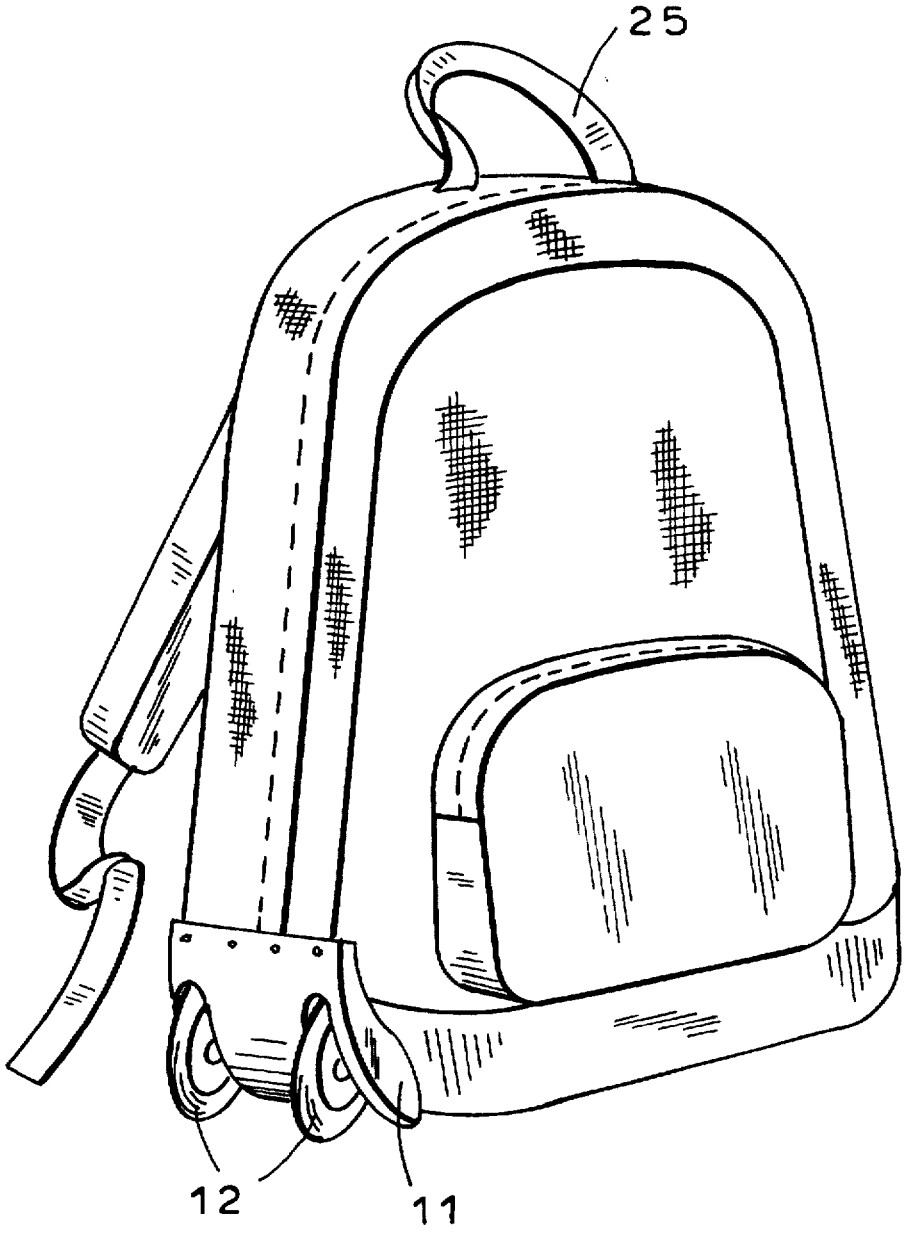
FIG. 3 is a view showing the application of the scuff preventing member to a backpack.

FIG. 3 shows that the member 11 with its wheels 12 and, if desired, also the handle system 13, 14, 15, can be applied as well to a backpack, although, where the backpack has a handle 25 with which it may be drawn along the ground, the handle system 13 through 15 can be eliminated.

Figure 4:
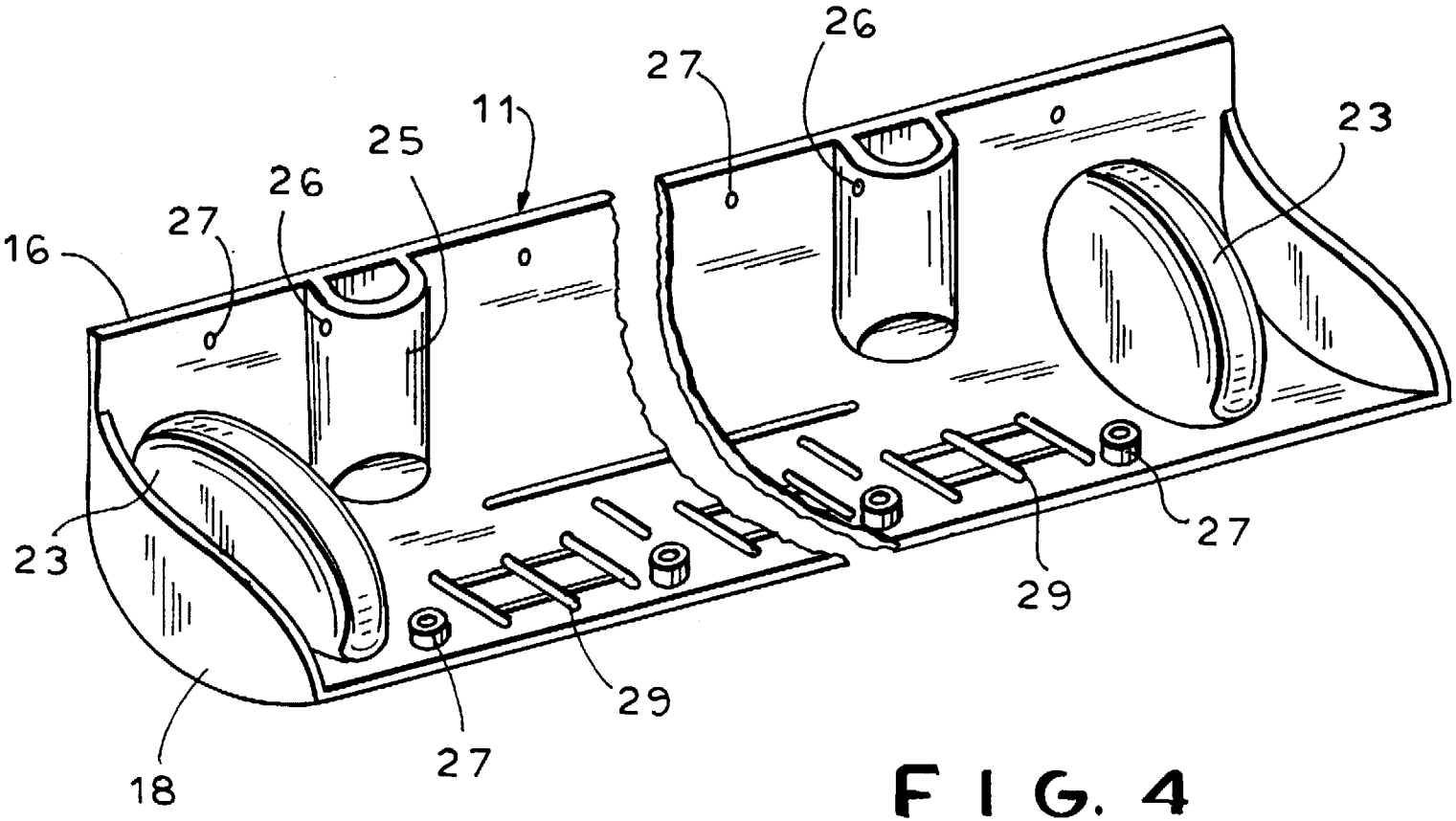
FIG. 4 is a perspective view showing the inner side of the scuff preventing member.

FIG. 4 shows the interior of the member 11 with its molded wheel wells 23 and a pair of integrally molded sockets or seats 25 which can accommodate the tubes 15 previously mentioned, a pin or the like being inserted through the bore 26 of each socket to hold the tube in place. FIG. 4 also shows the bores 27 in the planar portion 16 of member 11 to accommodate the bolts or rivets 22.

Furthermore, the planar portion 17 can be integrally molded with studs 27 which can project or the like in the bottom of the duffle or backpack or to be engaged by a screw or the like from within the interior of the duffle or the backpack.

The rounded portion 18 is also visible in this figure, as are ribs 29 which can stiffen the bottom portion of member 11 and likewise are integrally molded with the remainder of the scuff resisting member 11. Apart from the wheels and the wheel axles, therefore, and any fastening members used, the entire wheel and scuff resistant assembly is integrally molded in one piece entirely from an abs or other wear resistant plastic.

We claim:

1. A bottom protector for a duffle bag formed with a supported side and a bottom, comprising a one-piece member molded from synthetic resin material and having an arcuate portion and provided with means for affixing said member to said wall and said bottom and bridging a pair of planar portions which are mutually perpendicular, a pair of webs at opposite ends of said member perpendicular to said planar portions and bridging said planar portions while being adapted to flank the duffle bag, a pair of spaced apart tubular seats and a pair of wheel wells formed in said arcuate portion proximal to the respective webs and flanking said pair of seats for receiving wheels on which said duffle bag can ride as said duffle bag is drawn over the ground.

2. The bottom protector defined in claim 1 wherein said arcuate portion is a segment of a cylindrical arc extending through substantially 90° and with a radius of curvature of at least 4 inches.

3. A rolling duffle bag comprising:

a bag of a flexible material having a supported side and free from rigid supporting structures along all other sides of the bag;

a stiff supporting sheet in said bag along said supported side;

an elongated framework secured to said bag and said supporting sheet at said supported side and having a pair of spaced apart parallel tubular guides open at one end of said framework;

a pull-out handle assembly having a pair of shanks received in said guides and extendable therefrom to enable pulling of said bag over the ground, and a handle bridging said shanks;

a one-piece abrasion-resistant bottom protector molded from a synthetic resin material and disposed at an opposite end of said framework along an exterior of said bag, said bottom protector being unitarily formed with:

an arcuate plate having a large radius of curvature of 4 to 8 inches and extending through an arc of substantially 90° between a first substantially planar portion secured to said supported side and to said sheet and a second substantially planar portion secured to an end of said bag and at a right angle to said first portion, a pair of webs transverse to said plate at opposite ends thereof and flanking said bag along further sides thereof said webs connecting said portions, respective wheel wells in a region of said arc proximal to said webs, and a pair of spaced apart tubular seats spaced laterally inwardly from the webs and between said wheel wells and open toward the framework, each of the seats removably receiving a respective one of the guides; and respective wheels rotatably mounted in said wheel wells.

4. The article defined in claim 3 wherein said bottom protector is further formed with a pair of pockets open toward said framework and receiving said tubular guides.

5. The article defined in claim 4 wherein said framework is formed with a bridge connecting said tubular guides and provided with a pushbutton latch for locking said assembly selectively in a retracted and in an extended position.

6. The article defined in claim 3 wherein said arc has a radius of curvature of 4.5 to 6 inches.

* * * * *